US006024021A

United States Patent [19]

Schultz

[11] Patent Number: 6,024,021

[45] Date of Patent: Feb. 15, 2000

[54] FRAGMENTING BULLET

[76] Inventor: Steven L. Schultz, P.O. Box 122, Johannesburg, Calif. 93528

[21] Appl. No.: 09/062,778

[22] Filed: Apr. 20, 1998

[51] Int. Cl.[7] ..... F42B 12/02; F42B 12/34

[52] U.S. Cl. ..... 102/506; 102/516; 102/517

[58] Field of Search ..... 102/398, 439, 102/501, 506–510, 514–518, 474, 519

[56] References Cited

U.S. PATENT DOCUMENTS

| | | | |
|---|---|---|---|
| 3,208,386 | 9/1965 | Schneider et al. . | |
| 3,780,657 | 12/1973 | Zaid . | |
| 3,881,416 | 5/1975 | Dilworth, Jr. . | |
| 3,911,820 | 10/1975 | Canon . | |
| 3,972,286 | 8/1976 | Canon . | |
| 4,603,637 | 8/1986 | Snide et al. . | |
| 4,777,882 | 10/1988 | Dieval . | |
| 4,805,536 | 2/1989 | Kosteck | 102/514 |
| 4,961,383 | 10/1990 | Fishman et al. . | |
| 5,078,054 | 1/1992 | Ashok . | |
| 5,097,767 | 3/1992 | Cirillo | 102/506 |
| 5,440,994 | 8/1995 | Alexander . | |
| 5,440,995 | 8/1995 | Levitt . | |
| 5,528,989 | 6/1996 | Briese . | |
| 5,569,874 | 10/1996 | Nelson . | |
| 5,616,642 | 4/1997 | West et al. . | |
| 5,679,920 | 10/1997 | Hallis . | |
| 5,852,255 | 12/1998 | Hallis et al. | 102/506 |

FOREIGN PATENT DOCUMENTS

| | | | |
|---|---|---|---|
| 72702 | 1/1894 | Germany . | |
| 3638721 | 5/1987 | Germany | 102/514 |
| 2003033 | 11/1993 | Russian Federation . | |
| 11087 | of 1901 | United Kingdom | 102/398 |
| 1110507 | 4/1968 | United Kingdom | 102/514 |

*Primary Examiner*—Harold J. Tudor
*Attorney, Agent, or Firm*—Richard C. Litman

[57] ABSTRACT

The invention is a fragmenting bullet comprising a copper jacket surrounding a core made from compressed, irregularly shaped lead rods. The bullet's nose has a truncated cone shape with a flat nose, wherein the jacket is open at the nose and extends slightly past the core. The bullet not only has the typical ability of fragmenting bullets to transfer energy to its target quickly and avoid overpenetrating the target, but is also able to penetrate soft body armor while retaining its other advantages.

3 Claims, 7 Drawing Sheets

FRAGMENTING BULLET

BACKGROUND OF THE INVENTION

1. Field of the Invention

The present invention relates to weapons and projectiles. Specifically, the invention is a frangible bullet having a copper jacket and a core comprising a plurality of lead rods which have been compressed into irregular shapes. The bullet shape is a truncated cone with a large, flat, open point, wherein the jacket extends slightly beyond the core. The design provides for excellent energy transfer from the bullet to the target, and prevents overpenetrating the target. The design also assists in penetrating soft body armor.

2. Description of the Related Art

Several past inventors have successfully designed a bullet which either fragmented or mushroomed inside the target to improve energy transfer between the bullet and target, and to prevent the bullet from overpenetrating the target. Such fragmentation or mushrooming increases shock and tissue damage to the target, resulting in humane kills during hunting, and allowing those lawfully defending themselves to quickly stop an attack. The bullet deformation also protects bystanders in two ways. First, the bullet is less likely to exit the target, injuring anyone who may be behind the target. Second, if the bullet strikes a hard surface, a substantial part of its energy will be used up in deforming the bullet, rather than causing a ricochet.

Other inventors have developed armor piercing projectiles, which are useful for law enforcement officers and others who must occasionally neutralize well-protected opponents. Most bullets designed primarily for penetration, however, deform very little on impact, resulting in smaller wound channels, less shock, and higher risks of overpenetration and ricochets.

The current invention's unique feature is that, unlike most of the prior art, it has the ability to maximize both energy transfer and penetration of soft armor, while also preventing overpenetration of the target and ricochets.

One example of a fragmenting bullet is U.S. Pat. No. 3,208,306, issued to Otto W. Schneider et al, describing a bullet having a core comprising compressed metal wires, and a copper jacket. Unlike the present invention, Mr. Schneider's bullet was designed to fragment while in flight, hitting the target with a shotgun-like pattern. Schneider's preferred embodiment is claimed to produce a 5 ft. dia. pattern at 25 yds. This invention would be unwise to use in many circumstances, because the individual projectiles lack sufficient mass for adequate penetration, and dangerous, because bystanders could be struck by fragments which miss the target.

Another bullet using a wire core was described by U.S. Pat. No. 5,528,989, issued to Torrey L. Briese. The bullet comprises a core of bent, irregularly shaped lead wires, with a copper jacket having a hollow point. A standard hollow point has cylindrical hole in the nose, going about halfway down the length of the bullet. Unlike a standard hollow point or the present invention, Briese's invention uses a hollow section underneath the jacket. This bullet is designed only for fragmentation, not penetration.

U.S. Pat. No. 5,569,874, issued to Eric A. Nelson, discloses a nonlead training bullet wherein the wire core is held in place by a copper jacket along the base, but the entire nose portion of the wire core is exposed. Because the bullet avoids the use of lead, it has insufficient density to be used for hunting or self-defense. Unlike the current invention, this bullet is specifically designed to avoid any penetration.

Another training bullet is described in U.S. Pat. No. 5,679,920, issued to John M. Hallis et al. The bullet comprises a core made from twisted nontoxic metal wires, surrounded by a copper jacket with only the tip exposed. It is intended to prevent both ricochets and lead contamination during practice. Mr. Hallis' patent, like Mr. Nelson's aforementioned patent, would lack sufficient density for hunting or defensive use.

Other frangible practice projectiles include U.S. Pat. No. 5,078,054, issued to Sankaranarayanan Ashok, describing a projectile with a core comprising powdered metal which has been compressed, sintered, and cooled; U.S. Pat. No. 4,603,637, issued to James A. Snide, describing a bullet with a core comprising a plurality of individual sections of polymeric material filled with metal; and U.S. Pat. No. 5,616,642, issued to Harley L. West, describing a lead-free training bullet comprising powdered metal within a polyester matrix.

One of the most commonly used frangible self defense bullets is described in U.S. Pat. Nos. 3,911,820 and 3,972,286, both issued to Jack Y. Canon. These patents describe a bullet comprising a hollow copper jacket with a plastic tip, filled with small, heavy metal spheres in a viscous or semi-solid fluid. When the bullet hits the target, the jacket is stripped away from the core, causing the core to spread out in a shotgun-like pattern inside the target. This bullet provides excellent energy transfer, protection from ricochet (by fragmenting instead of bouncing), and protection from overpenetration. It performs poorly when penetration is required, however.

U.S. Pat. No. 3,750,657, issued to Melvin Zaid, discloses a very unique and useful frangible bullet. Mr. Zaid's bullet is made from cement or plaster, and is intended to be lethal at ranges of only a very short distance, and nonlethal beyond that distance. This bullet is useful in situations where penetration must be kept to an absolute minimum, such as on an airplane. Conversely, the current invention is specifically designed to penetrate under certain conditions.

At the other end of the projectile performance spectrum are those designed for penetration instead of energy transfer. One example is U.S. Pat. No. 4,961,383, issued to Steven G. Fishman et al, which describes a bullet having a core made by compressing tungsten wires surrounded by steel powder at a temperature slightly below the melting point of the steel, under high pressure, hardening the resulting rod, and then machining the bullets from the rod. The resulting projectile will penetrate whatever it hits with little deformation, resulting in deep penetration and a small diameter wound channel.

U.S. Pat. No. 5,440,995, issued to Albert P. Levitt, described a penetrator for an armor piercing projectile similar to Mr. Fishman's aforementioned patent. Mr. Levitt's bullet is made by first combining thin tungsten fibers into a thicker fiber by heating them to a molten state, coating the resulting thicker fiber with one of several other metals, placing the coated fibers parallel to each other in a mold, and heating them to combine them. A projectile comprising such a penetrator, like the Fisher bullet, will deeply penetrate most targets, with little bullet deformation and therefore a small wound channel.

U.S. Pat. No. 5,440,994, issued to William Alexander, discloses a bullet which is claimed to be both armor piercing and frangible. The bullet comprises a copper jacket containing several flechettes pointed in the direction of travel of the bullet, and a nose cap. The patent claims that, on impact with soft body armor, the nose cap and jacket separate from the core. The flechettes have a high length to diameter ratio, and therefore have a high energy to cross sectional area ratio, making it easy for them to penetrate armor. Unlike the present invention, to penetrate, the flechettes are not compressed into the jacket and thus depend solely upon separation from the jacket so that, once separated, they do not tumble when they hit armor in order to penetrate. In contrast, the present invention utilizes the jacket to assist in penetration.

In addition to designs for bullets, two examples of inventions for delivering submunitions from a missile are U.S. Pat. No. 3,881,416, issued to Thomas E. Dilworth, Jr., and U.S. Pat. No. 4,777,882, issued to Gerard Dieval. Other foreign patents only generally related to bullet design include German Pat. No. 72,702 and Russian Pat. No. 2,002,033.

None of the above inventions and patents, taken either singularly or in combination, is seen to describe the instant invention as claimed. Thus a fragmenting bullet solving the aforementioned problems is desired.

SUMMARY OF THE INVENTION

The invention is a frangible bullet with the ability to penetrate soft body armor, in addition to having excellent ability to transfer energy to its target.

The bullet comprises a copper jacket and a core comprising a plurality of irregularly bent lead rods. The jacket is open at the bullet's nose, and extends slightly past the core. The nose will preferably have a truncated cone shape, with a flat nose. However, a wadcutter shape may also be used.

The core is best understood by describing the procedure for manufacturing the bullet. Beginning with a copper cylinder having a closed end and an open end, and a plurality of lead rods having a length longer than that of the cylinder, the rods are placed in the cylinder so that the axis of the rods is substantially parallel to the axis of the cylinder. The cylinder is then placed inside a die, and the lead wires are compressed with a punch under low pressure, causing them to bend, until they fill substantially the entire volume of the cylinder. At this point, the resulting lead core should be slightly shorter in length than the length of the cylinder, so that there is a slight copper edge at the top. This open top will become the nose of the bullet. Next, the bullet is placed in the appropriate die for swaging it into a truncated cone shape. The bullet can now be loaded into a standard casing, containing a standard primer and appropriate powder charge for the caliber bullet, to form a cartridge which can be used in any gun of the appropriate caliber.

The resulting bullet weighs slightly less than a standard bullet of equivalent caliber, and will behave like a standard bullet in flight. When the bullet strikes its target, the jacket mushrooms away from the core, and separates. The individual rods of the core separate in a shotgun-like pattern inside the target, causing a plurality of small wound channels resulting in extensive tissue damage. The wide wound pattern also increases the chances of striking one of the target's vital organs. The individual rods lose velocity faster than a single, solid projectile, thereby transferring their energy to the target more quickly. This fast energy transfer results in more extensive tissue damage and greater shock. It also reduces the chances that any fragments will penetrate completely through the target, causing injury to anyone unfortunate enough to be behind the target. The typical penetration is eight to twelve inches, which is sufficient to reach vital organs without creating a danger of overpenetration.

An additional advantage of such a frangible bullet is that, when it strikes a solid surface, its energy is used up to a large extent by fragmentation of the bullet, rather than in causing a ricochet which could endanger a bystander.

The final advantage of the present invention is its ability to retain its performance after striking soft body armor. Soft armor is typically made of polymer fibers, such as those marketed under the trademark KEVLAR, having a high tensile strength. The armor is typically less dense than living tissue. A typical rifle or handgun barrel contains rifling, which is a set of spiral grooves running the length of the barrel, intended to stabilize the bullet in flight by causing it to spin. When a bullet of the present invention strikes body armor, the bullet's spinning causes the copper edge around the nose to act like a saw, cutting through the fibers. Soft body armor is typically less dense than living tissue, so there is insufficient pressure against the nose of the bullet to cause fragmentation. When the bullet exits the body armor and enters living tissue, the increase in density, and corresponding increase in pressure against the nose of the bullet, results in fragmentation as described above.

Accordingly, it is a principal object of the invention to provide a bullet design which will maximize energy transfer from the bullet to the target, maximizing shock and tissue damage.

It is another object of the invention to provide a bullet which will reliably penetrate deeply enough to reach a target's vital organs without the danger that the bullet will exit the target.

It is a further object of the invention to provide a bullet which will minimize the danger of a ricochet when the bullet strikes a solid object.

Still another object of the invention is to provide a bullet which continues to fulfill the above objects after passing through soft body armor.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
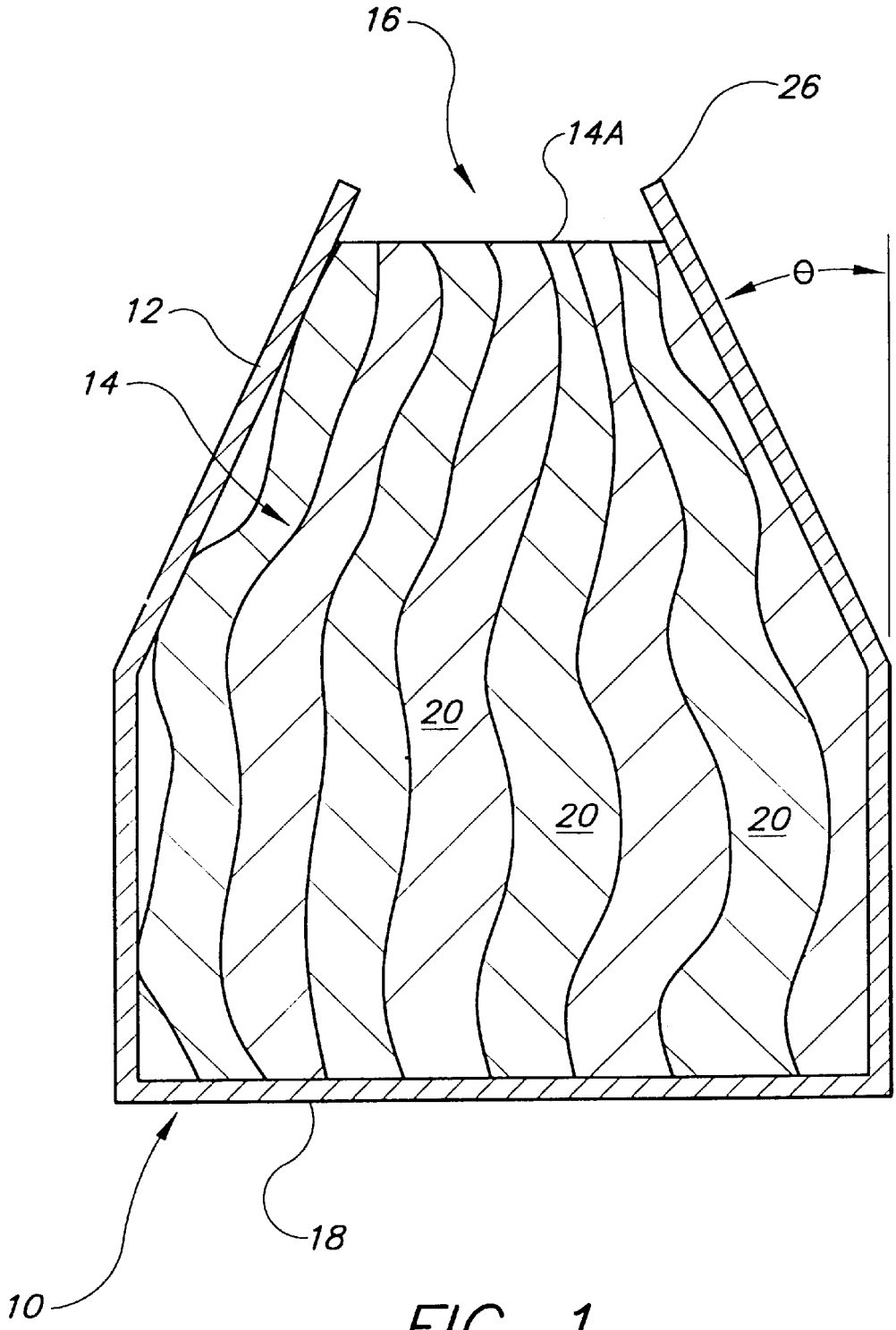
FIG. 1 is a cross sectional view of a fragmenting bullet according to the present invention.

Referring to FIG. 1, the present invention is a bullet, 10, comprising a copper jacket, 12, and core, 14, made from a plurality of compressed, irregularly shaped lead rods 20. The jacket 12 is open at the nose, 16, of the bullet, and also extends slightly past the core 14. In the preferred embodiment, the nose 16 is in the shape of a truncated cone with a large, flat point.

Figure 2:
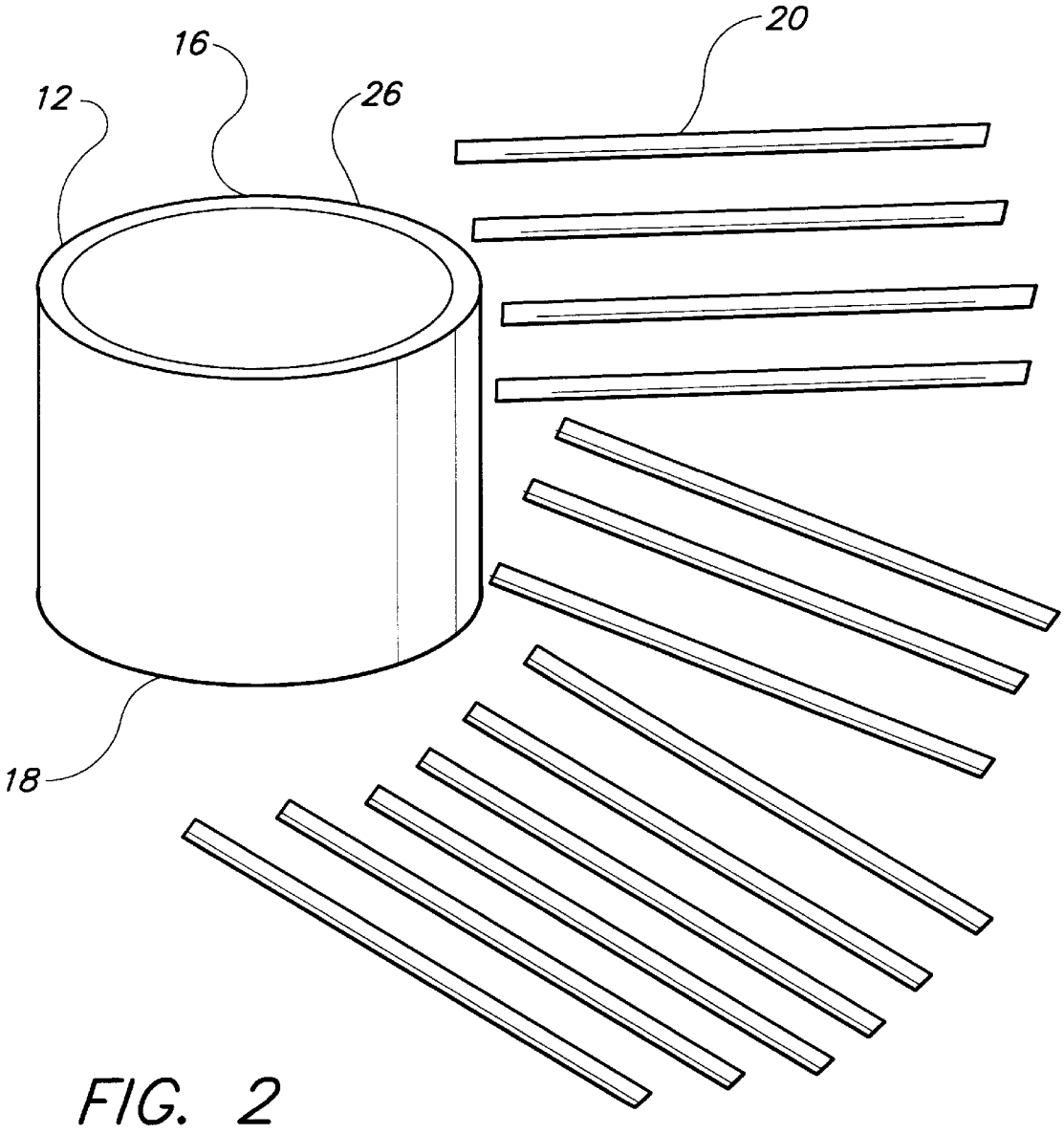
FIG. 2 is a perspective view of the bullet's raw materials.

The core of the bullet is best understood by describing the manufacturing process. Referring to FIG. 2, the jacket 12 begins as a copper cylinder with an open top 16 and a closed base 18. The individual lead rods, 20, are longer than the jacket. In the preferred embodiment of a 9 mm. bullet, thirteen rods 20, each weighing 8 grains, are used. For a .45 ACP, 23 rods are used. Using standard mathematical calculations, the proper volume of the jacket of a particular caliber can be established in order to choose a jacket 12 which has the proper height dimension which results in a nearly complete fill of the jacket volume with lead rods 20 as described below, while establishing the edge 26 of the jacket 12 slightly extending beyond the core 14 as described.

Figure 3:
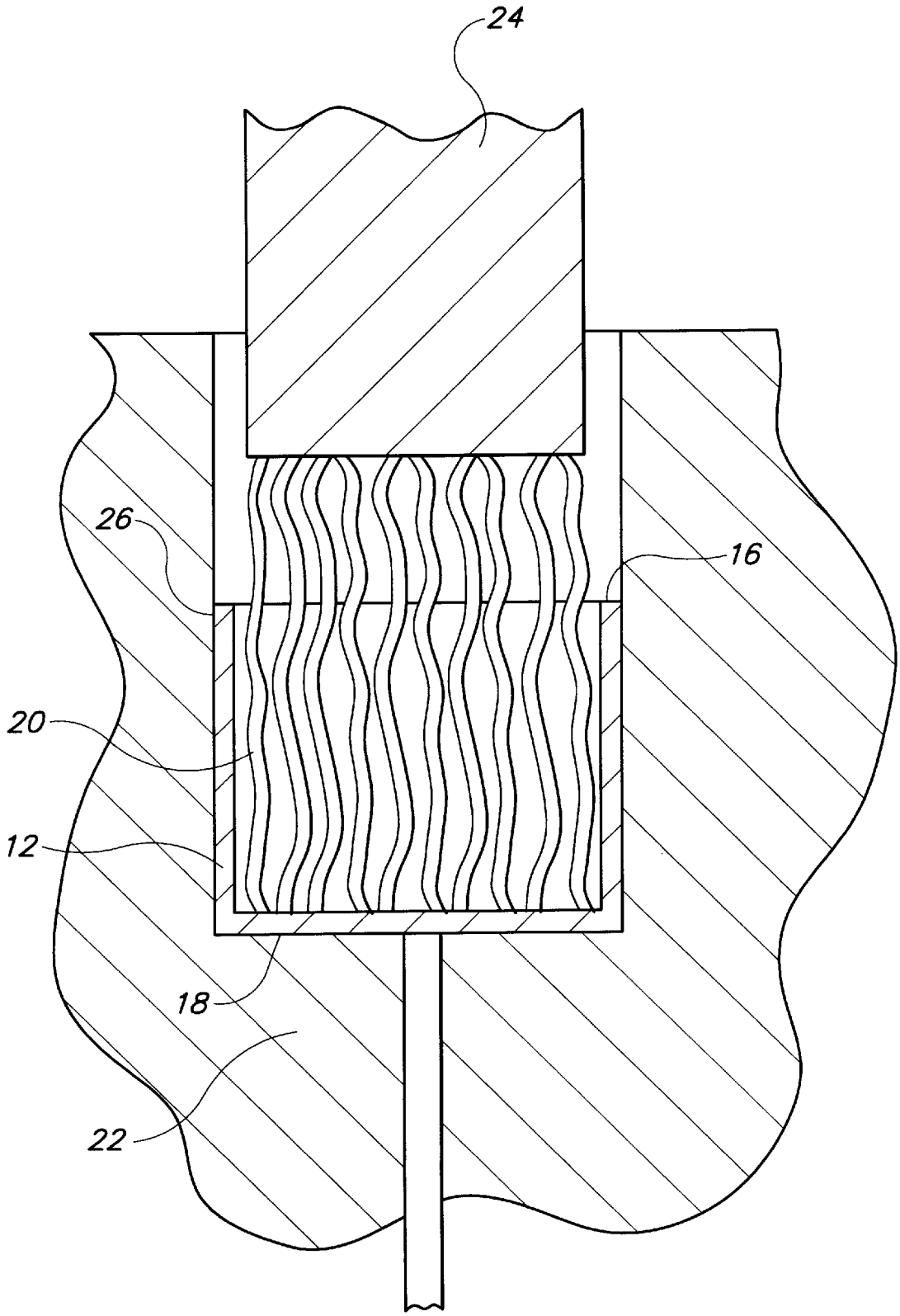
FIG. 3 is a diagrammatic, cross sectional view of the process of compressing the bullet's core into the jacket.
Figure 4:
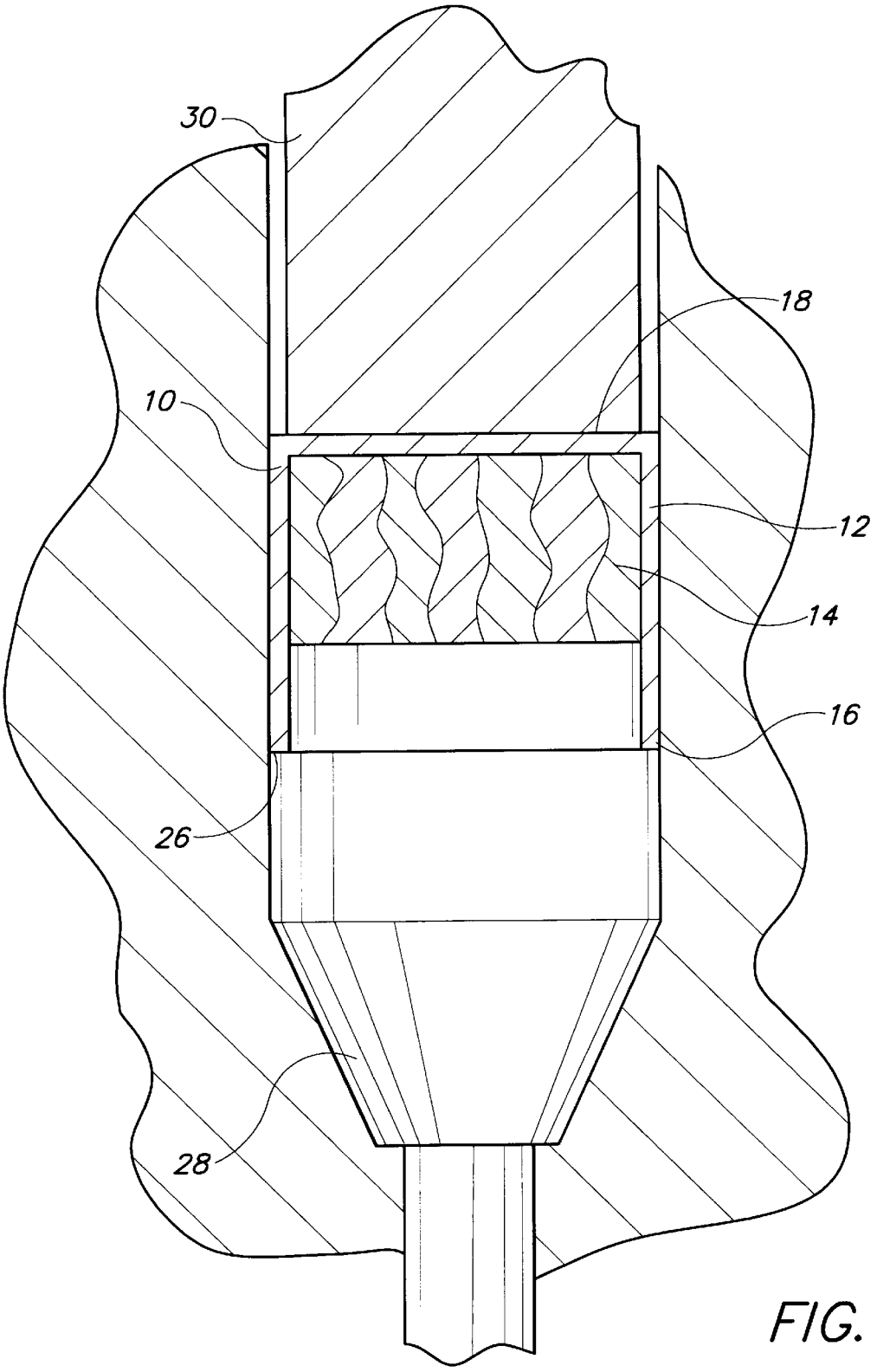
FIG. 4 is a diagrammatic, cross sectional view of the process of swaging the bullet to its final shape.

Referring to FIG. 3, the lead rods 20 are placed inside the jacket 12 so that they are parallel to the axis of the jacket 12, and compressed under low pressure using die 22 and punch 24 so that they bend into irregular shapes, filling approximately ⅔ of the jacket 12. The resulting core 14 is slightly shorter than the jacket, leaving a copper edge, 26, around the top 16. Referring to FIG. 4, the bullet 10 is then swaged using die 28 and punch 30, under low pressure, into the shape of a truncated cone. The resulting bullet now resembles bullet 10 in FIG. 1, and can be loaded into a standard casing, containing a primer and an appropriate powder charge, for use in a gun of the appropriate caliber.

Figure 7:
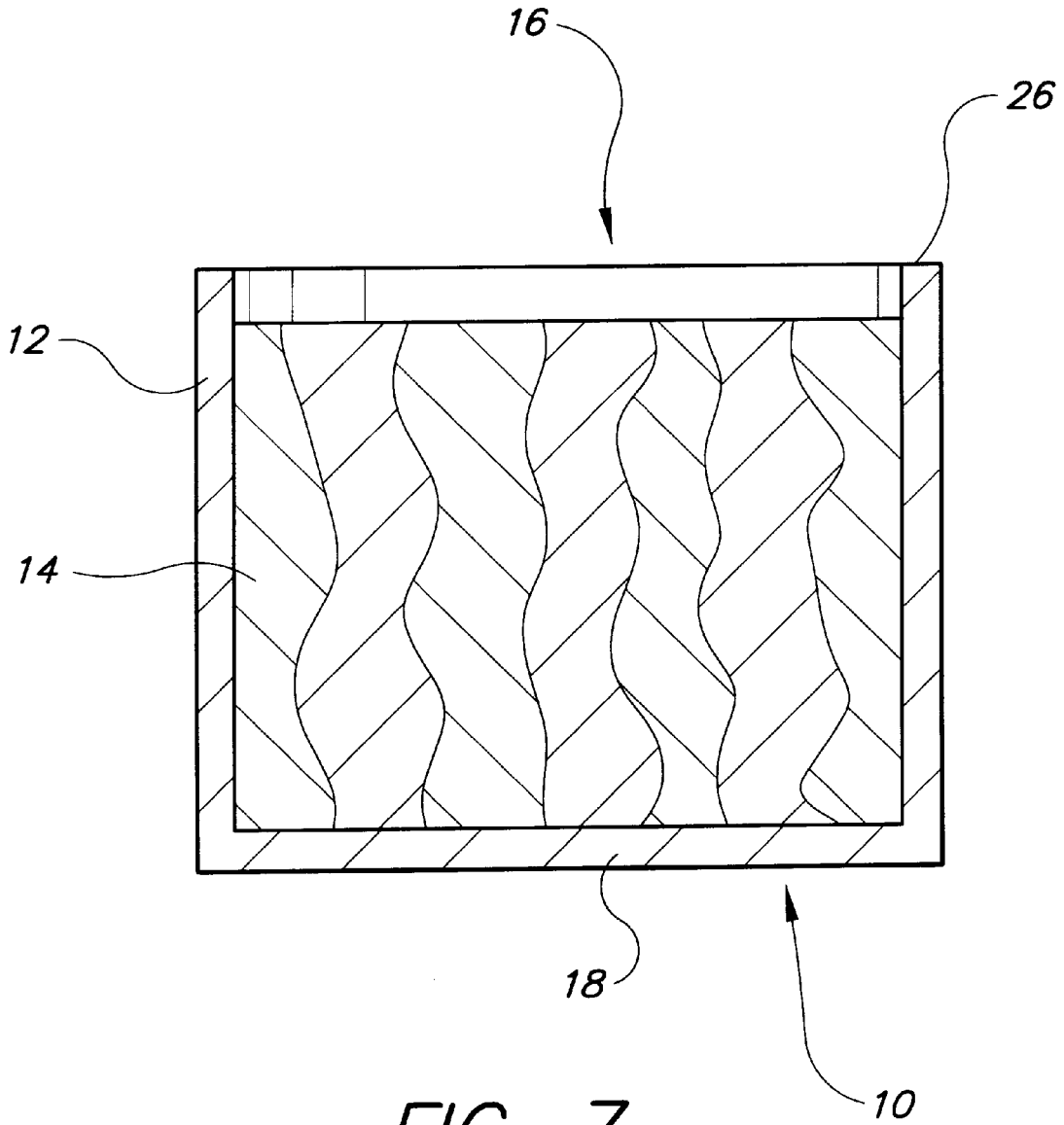
FIG. 7 is a cross sectional view of a second embodiment wherein the bullet is in the shape of a cylindrical wadcutter.

In the preferred embodiment, the angle θ shown in FIG. 1 is 22°. This angle θ results in penetration of approximately ¾ inch before fragmentation. However, angles θ of 19° to 26° have been tested by the inventor. Decreasing the angle θ results in faster fragmentation and reduced penetration. A 19° angle θ, for example, will cause fragmentation on impact, and a 26° angle θ will result in penetration of 3 in. before fragmentation. From this disclosure, it is therefore apparent that other angles could be used to change the balance of penetration compared to fragmentation, with predictable results. For example, referring to FIG. 7, a second embodiment is shown. This embodiment approximates the shape of a cylindrical wadcutter, and results in rapid fragmentation.

Figure 5:
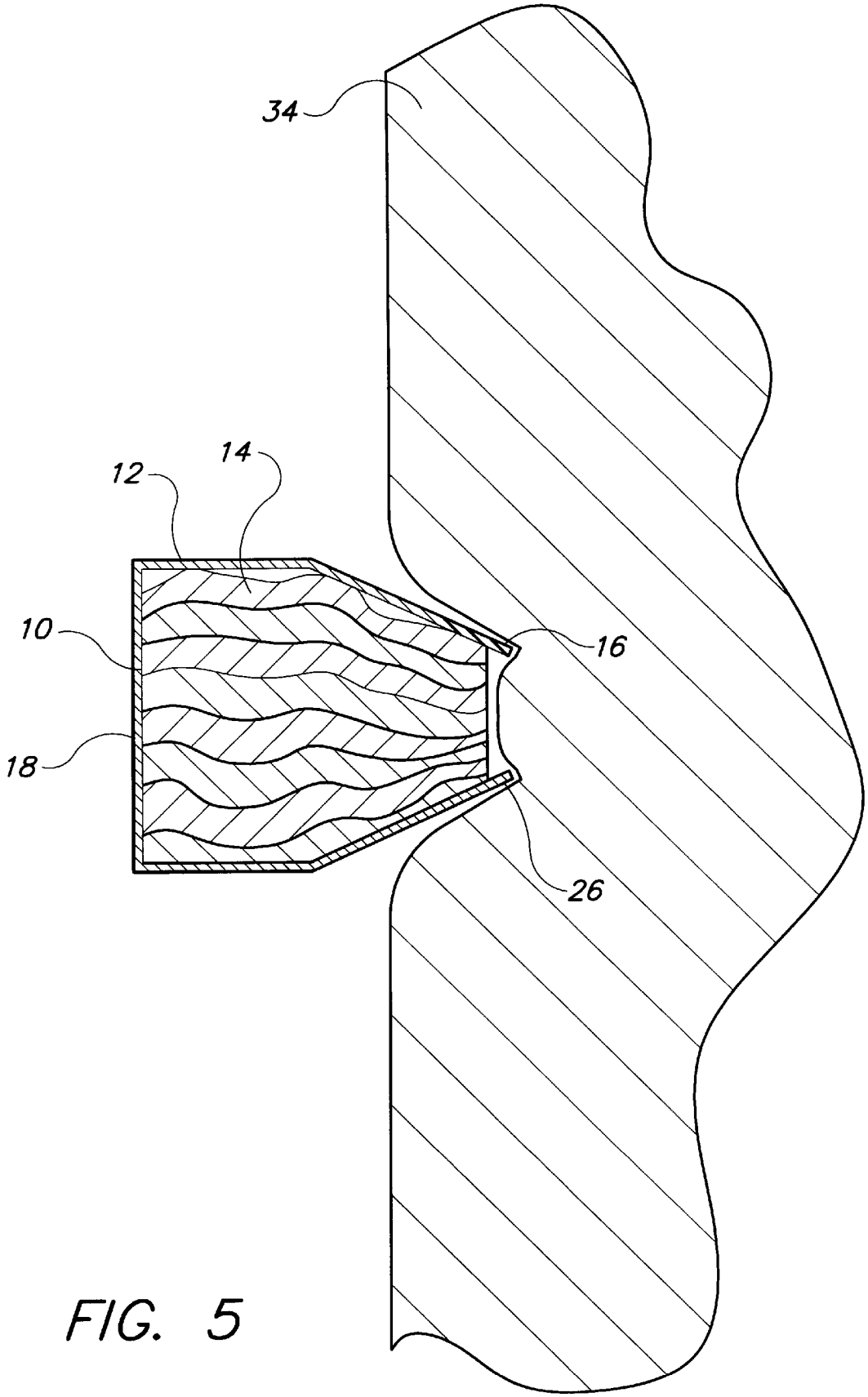
FIG. 5 is a diagrammatic, cross sectional view of the bullet striking soft body armor.

FIG. 5 shows how the bullet penetrates soft body armor, 34. The bullet is spinning due to the rifling of the gun, intended to stabilize the bullet during flight, and thereby enhance accuracy. This spinning also causes the copper edge 26 around the point 16 to act like a saw when it strikes soft body armor 34. Such armor is less dense than living tissue, and therefore will not exert enough pressure on the nose to cause fragmentation. In testing, a 9 mm., a .38 spl. +P, a .45 ACP, and a .357 mag. were all able to penetrate level IIA armor. When tested against level IIIA armor, the .357 mag. was still able to completely penetrate it, with the 9 mm. and .45 ACP penetrating halfway through the armor.

Figure 6:
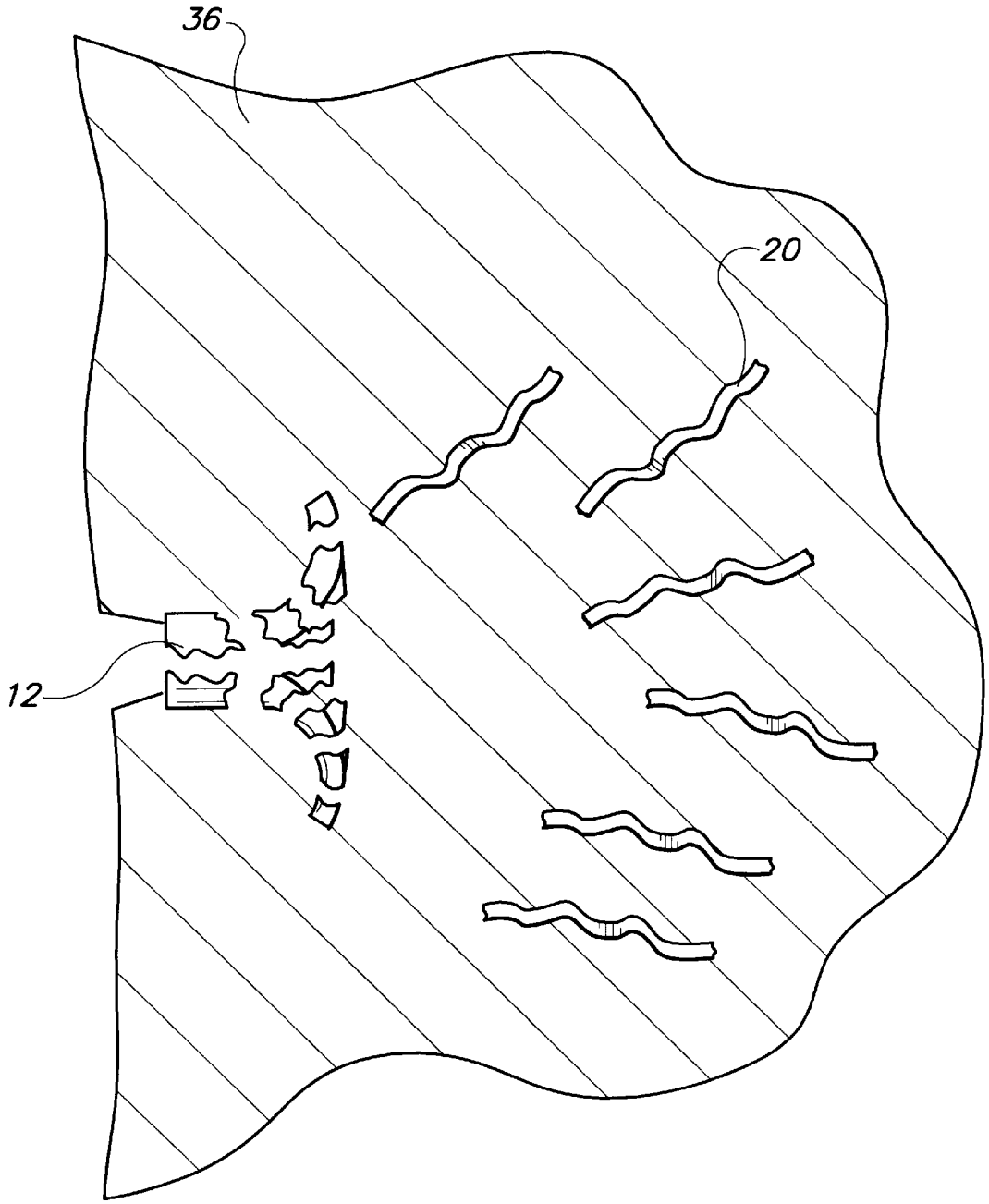
FIG. 6 is a diagrammatic, cross sectional view of the bullet breaking up into its various fragments after striking its target.

FIG. 6 shows the bullet's fragmentation once it hits living tissue, 36. Once the bullet 10 has penetrated approximately ¾ inch, the jacket 12 is peeled back, fragments, and is stripped away from the core 14. The individual lead rods 20 in the core spread out in a shotgun-like pattern which is about 6 in. wide after 6 in. of penetration. The rods have completely stopped moving after penetrating a total of eight to twelve inches. The individual fragments 20 create multiple small wounds resulting in a large amount of tissue damage. They also increase the probability that vital organs will be struck as compared to a single projectile having a single path. Of equal importance, the fragments 20, having a weight of approximately 8 grains in the preferred embodiment, are unlikely to exit the target and cause injury to a bystander.

It is to be understood that the present invention is not limited to the embodiments described above, but encompasses any and all embodiments within the scope of the following claims.

I claim:

1. A fragmenting bullet comprising:

a cylindrical core including a plurality of compressed lead rods, each of said rods being irregular in shape and weighing approximately 8 grains, said core having a length and a flat surface defining a point end; and a copper jacket surrounding said core, said jacket having a cylindrical body portion and an open nose portion defining an edge, said jacket having a length slightly greater than the length of said core such that said edge extends slightly beyond the flat surface of said core;

wherein said open nose portion has a truncated cone shape and forms an angle of 19° to 26° with the body portion of said jacket.

2. The bullet according to claim 1, wherein said nose portion forms an angle of 22° with the body portion of said jacket.

3. A fragmenting bullet comprising:

a cylindrical core including a plurality of compressed lead rods, each of said rods being irregular in shape and weighing approximately 8 grains, said core having a length and a flat surface defining a point end; and a copper jacket surrounding said core, said jacket having cylindrical body portion and an open nose portion defining an edge, said jacket having a length slightly greater than the length of said core such that said edge extends slightly beyond the flat surface of said core;

wherein said open nose portion has cylindrical shape and forms an angle of 0° with the body portion of said jacket.

* * * * *